United States Patent [19]

Ueno et al.

[11] Patent Number: 4,990,961

[45] Date of Patent: Feb. 5, 1991

[54] ELECTROPHOTOGRAPHIC APPARATUS WITH VARIABLE BIAS VOLTAGE

[75] Inventors: Yukihiko Ueno, Hirakata; Yasutaka Maeda, Ikoma; Etsuzi Nukushina, Nara; Tsuyoshi Miyamoto, Osaka; Kyouichi Takata, Yamatokoriyama; Hiromi Washio, Osaka, all of Japan

[73] Assignee: Sharp Kabushiki Kaisha, Osaka, Japan

[21] Appl. No.: 337,610

[22] Filed: Apr. 13, 1989

[30] Foreign Application Priority Data

Apr. 15, 1988 [JP] Japan ..... 63-93852

[51] Int. Cl.[5] ..... G03G 15/09

[52] U.S. Cl. ..... 355/251; 118/645; 118/657; 118/661; 355/246; 355/326; 355/327

[58] Field of Search ..... 355/246, 326, 327, 253, 355/251; 118/645, 661, 657

[56] References Cited

U.S. PATENT DOCUMENTS

| | | | |
|---|---|---|---|
| 4,077,358 | 3/1978 | Kito | 355/251 X |
| 4,460,267 | 7/1984 | Ogawa | 355/251 |
| 4,540,272 | 9/1985 | Abe et al. | 355/327 |
| 4,600,295 | 7/1986 | Suzuki | 355/246 |
| 4,754,301 | 6/1988 | Kasamura et al. | 355/326 X |
| 4,755,850 | 7/1988 | Suzuki et al. | 355/246 X |
| 4,f814,834 | 3/1989 | Endo et al. | 355/246 X |

FOREIGN PATENT DOCUMENTS

| | | |
|---|---|---|
| 53-33341 | 1/1978 | Japan . |
| 55-42392 | 10/1980 | Japan . |

*Primary Examiner*—Fred L. Braun
*Assistant Examiner*—Thu Anh Dang
*Attorney, Agent, or Firm*—Irell & Manella

[57] ABSTRACT

An electrophotographic apparatus having: a developer unit that has a magnetic developing roller for applying toner to electrostatic latent image areas formed on the surface of a photoconductor and that has a shutter which is closed to regulate the distribution of the toner to the photoconductor, a developing bias voltage for controlling adherence of the toner to the photoconductor being applied to said developer unit; and a bias voltage source for applying, when the shutter of the developer unit is closed, a developing bias voltage of the level between 0V and the developing bias voltage applied when the shutter is opened, thereby preventing blank spots from appearing in transferred images without increasing image-overtoning and also preventing damages from being caused to the surface of the fuser rollers of a fuser unit.

3 Claims, 3 Drawing Sheets

ELECTROPHOTOGRAPHIC APPARATUS WITH VARIABLE BIAS VOLTAGE

BACKGROUND OF THE INVENTION

1. Field of the Invention

This invention relates to an electrophotographic apparatus such as an electrostatic image transfer-type color copying machine and a laser printer.

2. Description of the Prior Art

A conventional electrostatic image transfer-type color copying machine is provided with a developer unit disposed adjacent to the surface of a photoconductor, the developer unit having a magnetic developing roller used to apply toner to the photoconductor to convert a latent image formed on the photoconductor into a visible image. Generally, the developer unit has a shutter which is opened and closed to control the distribution of the toner to the surface of the magnetic developing roller that faces the electrostatic latent image areas on the photoconductor, thereby controlling the distribution of the toner to the photoconductor. Furthermore, in such a copying machine, it is usual to apply a developing bias voltage to the magnetic developing roller of the developer unit during the copy process in order to prevent adherence of the toner to the non-image areas where no image is formed on the photoconductor. The developing bias voltage is maintained at a constant level throughout the copy process. Japanese Patent Publication No. 55-42392 discloses a copying machine wherein a lower voltage than a developing bias voltage is applied when the photoconductor is cleaned with the magnetic developing roller, but in this case also, the developing bias voltage is maintained at a constant level, although bias voltage is varied for the cleaning process.

However, when the developing bias voltage is maintained at a constant level throughout the copy process as described above, the following problems arise when the shutter is in a closed position, while there is not much problem when the shutter is in an open position. That is, since the magnetic developing roller is sparsely loaded with developer after the shutter of the developer unit is closed, the carrier tends to stick to the photoconductor. If carrier sticks to the photoconductor, toner will not adhere to the areas on the photoconductor where the carrier has stuck, possibly causing blank spots in the image transferred to the transfer paper, or if blank spots are not caused, resulting in an incomplete transfer. This also creates a problem in that the surface of a fuser roller is damaged by the carrier stuck on the copy paper.

SUMMARY OF THE INVENTION

The electrophotographic apparatus of this invention, which overcomes the above-discussed and numerous other disadvantages and deficiencies of the prior art, comprises a developer unit that has a magnetic developing roller for applying toner to electrostatic latent image areas formed on the surface of a photoconductor and that has a shutter which is closed to regulate the distribution of the toner to the photoconductor, a developing bias voltage for controlling adherence of the toner to the photoconductor being applied to said developer unit; and a bias voltage applying means for applying, when said shutter of said developer unit is closed, a developing bias voltage of a level between 0 V and the developing bias voltage applied when said shutter is opened.

The bias voltage applying means applies, when said magnetic developing roller of said developer unit is not rotating, a developing bias voltage of a level between 0 V and the developing bias voltage applied when said magnetic developing roller is rotating.

The bias voltage applying means applies, when said electrostatic latent image areas formed on the photoconductor are not facing said magnetic developing roller of said developer unit, a developing bias voltage of a level between 0 V and the developing bias voltage applied when said electrostatic latent image areas are facing said magnetic developing roller.

Thus, the invention described herein makes possible the objectives of (1) providing an electrophotographic apparatus that prevents blank spots from appearing in transferred images without substantially increasing image-overtoning; and (2) providing an electrophotographic apparatus that reduces the carrier's adherence to transfer paper, thereby preventing damages from being caused to the surface of the fuser rollers of a fuser unit.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
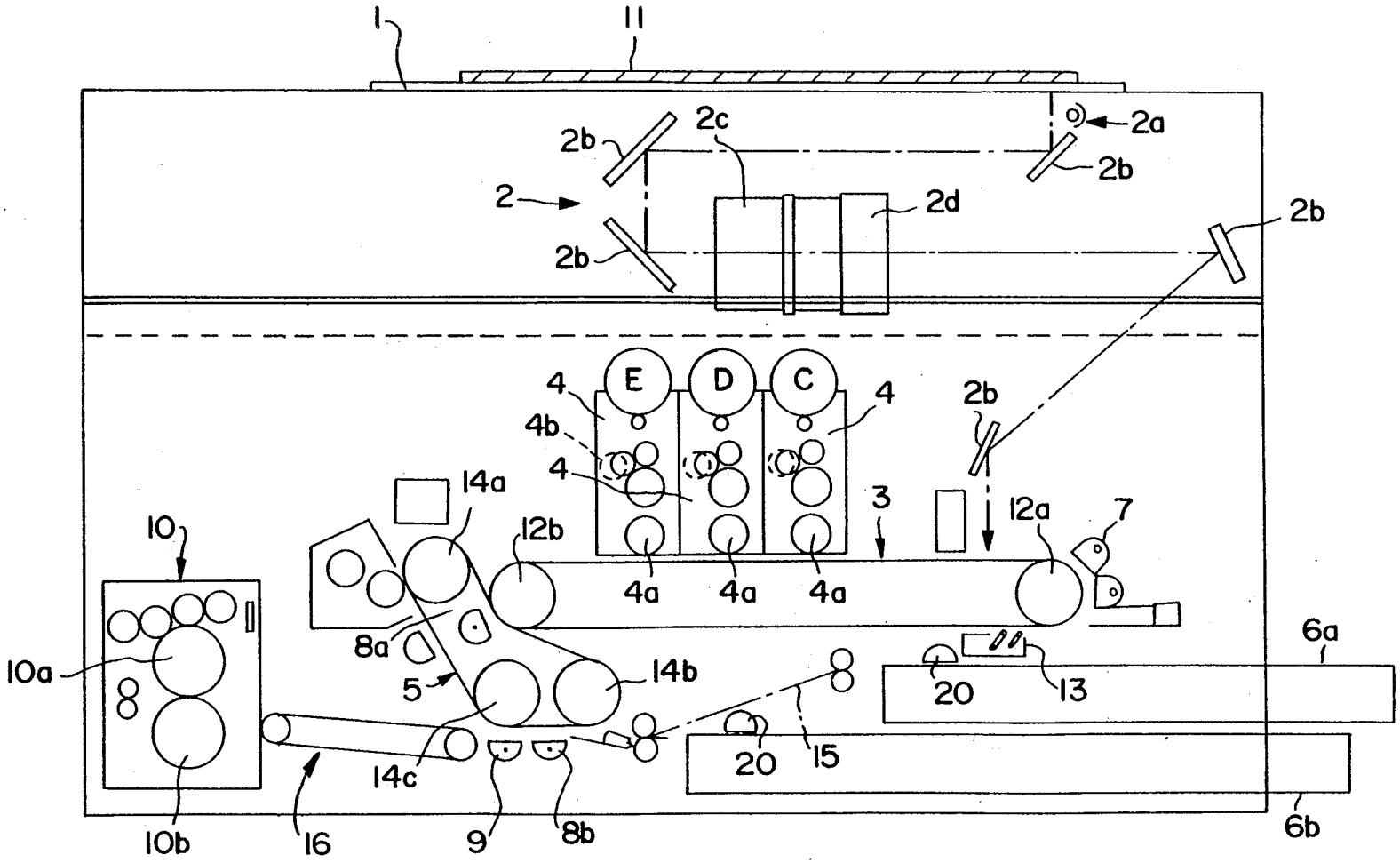
FIG. 1 is a side view showing an electrophotographic apparatus of this invention.

This invention provides an electrophotographic apparatus in which when the shutter of a developer unit is closed, a bias voltage applying means applies a developing bias voltage to the developer unit, the level of the bias voltage being between 0 V and the developing bias voltage applied when the shutter is opened. For example, supposing that the developing bias voltage applied when the shutter is opened is set at a given negative voltage, if the same developing bias voltage were maintained while the shutter is closed, adherence of the carrier to the photoconductor could not be prevented satisfactorily, which results in blank spots in the transferred image, although overtoning of the image would be prevented to a satisfactory level by the reduction of the distribution of the toner to the photoconductor. Then, if the developing bias voltage is shifted in the positive direction when the shutter is closed, the performance that prevents the image overtoning phenomenon will slightly deteriorate, but the performance that prevents the appearance of blank spots will improve. Thus, the conditions for the prevention of blank spots in the transferred image are contradictory to the conditions for the prevention of the image overtoning. However, since tolerances are allowed for the degrees of blank spots and image overtoning, there exists a range between 0 V and the developing bias voltage applied when the shutter is opened, that can satisfy both conditions. It would therefore be ideal to set the developing bias voltage applied when the shutter is closed within the range that satisfies both conditions, but if the developing bias voltage is set at least between 0 V and above mentioned negative voltage, it is possible to prevent the appearance of blank spots without substantially increasing overtoning of the image. Also, by controlling the carrier adherence to the photoconductor in the above manner, it is possible to substantially reduce the carrier adherence to the transfer paper such as copy paper, thus preventing any damage caused to the surface of the fuser roller in the fuser unit.

It must be appreciated that 0 V that is excluded from the range of the developing bias voltage to be applied when the shutter is closed, because the setting at 0 V would increase the toner adherence to the photoconductor, resulting in an increase in the toner consumption as well as in the image overtoning, although the carrier adherence to the photoconductor would be prevented.

Moreover, in the electrophotographic apparatus of this invention, the bias voltage applying means also works to apply, when the magnetic developing roller of the developer unit is not rotating, a developing bias voltage to the developer unit, the level of the bias voltage being between 0 V and the developing bias voltage applied when the magnetic developing roller is rotating.

For example, supposing that the developing bias voltage when the magnetic developing roller is rotating is set at a given negative voltage, if the same developing bias voltage were maintained when the magnetic developing roller of the developer unit is not rotating, it would not be possible to prevent the carrier from adhering to the photoconductor when the shutter is closed, resulting in blank spots in the transferred image. Therefore, the developing bias voltage when the magnetic developing roller is not rotating is set at a level between 0 V and the developing bias voltage applied when the magnetic developing roller is rotating. This is because the conditions for prevention of blank spots in the transferred image when the magnetic developing roller is not rotating are contradictory to the conditions for prevention of the image overtoning for the same reason as in the aforemenioned case. Thus, it is possible to prevent blank spots from appearing without substantially increasing image overtoning. It is also possible to reduce the carrier adherence to the transfer paper such as copy paper, thus preventing damage from being caused to the surface of the fuser roller in the fuser unit. Also, for the same reason as in the aforementioned case, 0 V is excluded from the range of the developing bias voltage.

Furthermore, in the electrophotographic apparatus of this invention, the bias voltage applying means also works to apply, when the electrostatic latent image areas on the photoconductor are not facing the magnetic developing roller of the developer unit, a developing bias voltage to the developer unit, the level of the bias voltage being between 0 V and the developing bias voltage applied when the electrostatic latent image areas on the photoconductor are facing the magnetic developing roller.

For example, supposing that the developing bias voltage when the electrostatic latent image areas formed on the photoconductor are not facing the magnetic developing roller is set at a given negative voltage, if the same developing bias voltage were maintained when the electrostatic latent image areas on the photoconductor are facing the magnetic developing roller, it would not be possible to prevent the carrier from adhering to the photoconductor when the shutter is closed, resulting in blank spots in the transferred image. The developing bias voltage to be applied when the electrostatic latent image areas are not facing the magnetic developing roller is therefore set at a level between 0 V and the developing bias voltage applied when the electrostatic latent image areas on the photoconductor are facing the magnetic developing roller. This is because the conditions for prevention of blank spots in the transferred image when the electrostatic latent image areas are not facing the magnetic developing roller are contradictory to the conditions for prevention of the image overtoning for the same reason as in the aforementioned case. Thus, it is possible to prevent blank spots from appearing without substantially increasing image overtoning. It is also possible to reduce the carrier adherence to the transfer paper such as copy paper, thus preventing damage from being caused to the surface of the fuser roller in the fuser unit. For the same reason as in the aforementioned case, 0 V is excluded from the range of the developing bias voltage.

EXAMPLE 1

FIG. 1 shows an electrostatic image transfer-type color copying machine, an example of the electrophotographic apparatus of this invention, which is provided with a manuscript stand 1 made of transparent glass or the like on the top surface thereof on which a manuscript 11 is to be placed. Beneath the manuscript stand 1 is disposed an exposure optical system 2 for exposing a photoconductor 3 and forming an electrostatic latent image corresponding to the image of the manuscript 11 onto the photoconductor 3. The exposure optical system 2 comprises an exposure lamp **2*a* for projecting light onto the manuscript 11 placed on the manuscript stand 1, a plurality of reflecting mirrors 2*b* for the directing the light reflected from the manuscript 11 onto the photoconductors 3, an image-forming lens 2*c* disposed in the optical path, and color separation filters 2*d*** consisting of filters of the three primary colors, red, green, and blue.

Beneath the exposure optical system 2 is disposed the photoconductor 3 which is formed of an endless belt. The photoconductor 3 is driven for rotation by a first roller **12*a* and a second roller 12*b* on which the photoconductor 3 is wound. Above the approximately middle part of the photoconductor 3 are disposed three developer units 4 in a non-contacting fashion. The developer units 4 contain color toner for yellow, magenta, and cyan, which are respectively the complementary colors of the colored filters in the color separation filters 2d. Each developer unit 4 is provided with a magnetic developing roller 4a which is used to apply toner to the electrostatic latent image areas formed on the photoconductor 3 through the exposure optical system 2. Each developer unit 4 is also provided with a shutter 4b which is closed to regulate the distribution of the toner to the surface of the magnetic developing roller 4a that faces the photoconductor 3, thereby controlling the toner distribution to the photoconductor 3. Under the first roller 12a disposed upstream of the developer units 4, a cleaning unit 13 is provided which is used to remove any remaining toner on the surface of the photoconductor 3 that is coming back toward the first roller 12a. Around the photoconductor 3 above the cleaning unit 13, are disposed a number of units including a corona charger 7 for charging the surface of the photoconductor 3**.

A sheet-like transfer intermediate member 5 which is driven for rotation by three rollers 14a, 14b and 14c is installed so that the member 5 is pressed against the portion of the photoconductor 3 which corresponds to the second roller 12b disposed downstream of the developer units 4. Behind the portion of the transfer intermediate member 5 that is pressed against the photoconductor 3, is disposed a transfer charger 8a which transfers the toner attracted to the electrostatic latent image areas on the photoconductor 3 onto the transfer intermediate member 5. Further, under the transfer intermediate member 5, are disposed a transfer charger 8b for transferring the image transferred to the transfer intermediate member 5 onto transfer paper 15 and a separation charger 9 for separating the transfer paper 15 from the transfer intermediate member 5.

Beneath the first roller 12a are disposed paper cassettes 6a and 6b for holding sheets of transfer paper 15 of different sizes. Each of the paper cassettes 6a and 6b is provided with a semicircular shaped roller 20 on the upper surface thereof for feeding the transfer paper 15 from the paper cassettes 6a and 6b. Downstream of the separation charger 9 in the transporting direction of the transfer paper 15 is disposed a conveyance belt 16 for conveying the transfer paper 15, and downstream of the conveyance belt 16 is provided a fuser unit 10 having fuser rollers 10a and 10b for fixing the image transferred to the transfer paper 15.

Figure 2:
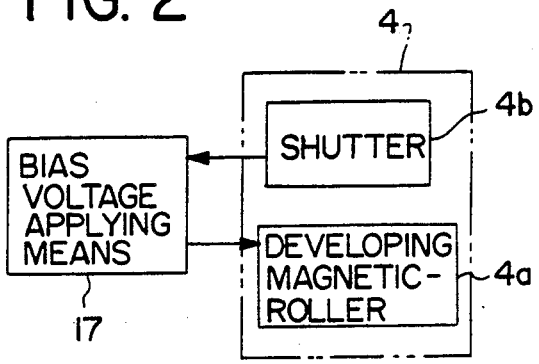
FIG. 2 is a block diagram showing the relationship among the developing unit, the shutter of the developing unit, and the bias voltage applying means of the electrophotographic apparatus shown in FIG. 1.
Figure 3:
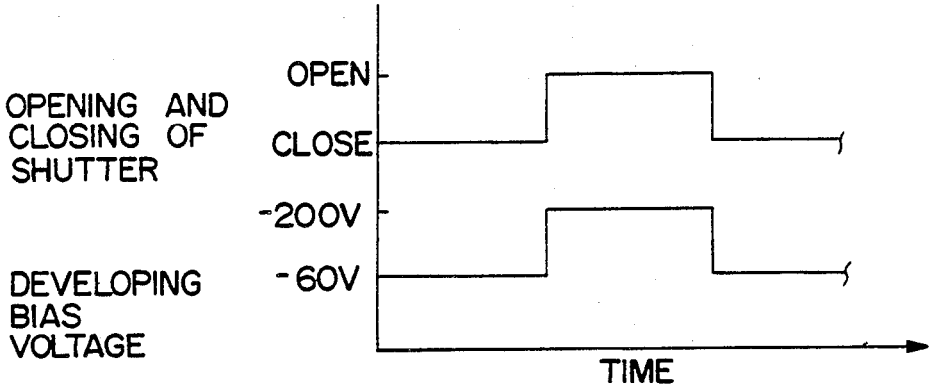
FIG. 3 is a timing chart showing the relationship between the opening and closing of the shutter and the developing bias voltage of the electrophotographic apparatus shown in FIG. 1.

The copying machine of this invention is provided with a bias voltage applying means 17 shown in FIG. 2, which is used to apply a specified developing bias voltage to the developer unit 4 when the shutter 4b of the developer unit 4 is opened, and when the shutter 4b of the developer unit is closed (the open position being shown in dotted fashion) a developing bias voltage of the level between 0 V and the developing bias voltage applied when the shutter 4b is opened. In this example, as shown in FIG. 3, the bias voltage applying means 17 is designed to apply to the developing units 4 a developing bias voltage of −200 V when the shutter 4b is opened and −60 V when the shutter 4b is closed.

Figure 4:
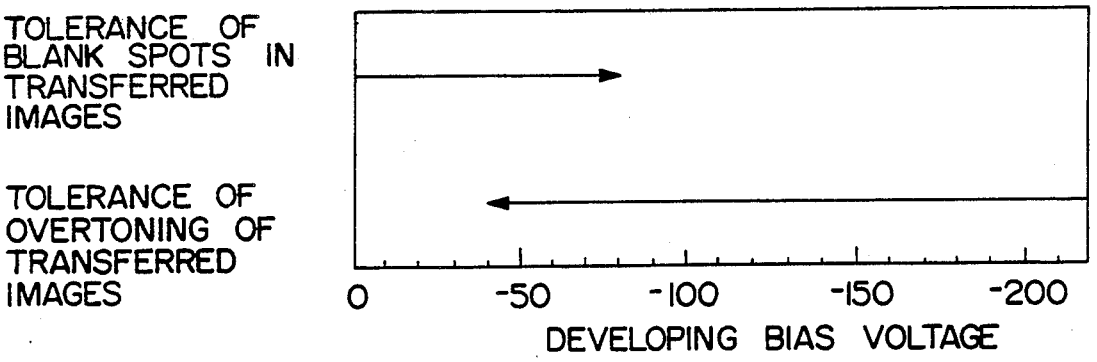
FIG. 4 is a diagram showing the relationship between the tolerance of blank spots appearing in transferred images and the tolerance of overtoning in the transferred images when the shutter is closed, when the magnetic developing roller is not rotating, and when the magnetic developing roller is not facing the electrostatic latent image area formed on the photoconductor with regard to the electrophotographic apparatus shown in FIG. 1.

The setting of the developing bias voltage at the above-mentioned values are determined for the following reason. When the developing bias voltage applied when the shutter 4b is opened is set at −200 V, it is found as shown in FIG. 4 that −80V is the maximum permissible bias voltage for the carrier adherence to stay within the allowable range, i.e. within the tolerance of blank spots appearing in the transferred image. On the other hand, −40 V is the minimum permissible developing voltage for the toner adherence to stay within the allowable range, i.e. within the tolerance of overtoning of the transferred image. Thus, the conditions for prevention of blank spots from appearing in the transferred image are contradictory to the conditions for prevention of the image overtoning, but the developing bias voltage within the range of −40 to −80 V satisfied both conditions. The setting of −60V is therefore determined by taking the mean value of the above developing bias voltage range.

The operation of the copying machine of this invention with the above construction is illustrated below.

When the print switch (not shown) is pressed ON, the light of the exposure lamp 2a is projected onto the manuscript 11 placed on the manuscript stand 1 to scan the manuscript a number of times. The light reflected from the manuscript 11 is directed through the reflecting mirrors 2b and the image-forming lens 2c into the color separation filters 2d where the optical image is separated into color components. In the meantime, the photoconductor 3 moves, driven by the first roller 12a and second roller 12b, while at the same time being uniformly charged by the corona charger 7. The optical images obtained through a number of the above scanning operations and filtered into color components through the color filters in the color separation filters 2d are sequentially projected onto the photoconductor 3 to form respective electrostatic latent images on the photoconductor 3. The resulting latent images relating to separate color components are respectively developed by the yellow, magenta, and cyan developer contained in the developing units 4 to convert into visible images.

In the above developing process, when the electrostatic latent image areas on the photoconductor 3 come to the position facing each developer unit 4, the shutter 4b of the developer unit 4 is opened to apply each color toner to the electrostatic latent image areas by means of the magnetic developing roller 4a. At this time, a developing bias voltage of −200 V is applied to the developer units 4 by the bias voltage applying means 17, so that adherence of the toner to the nonimage areas can be prevented. When the electrostatic latent image areas on the photoconductor 3 have passed, the shutter 4b of each developer unit 4 is closed. At this time, a bias voltage of −60 V is applied to the developer units 4 by the bias voltage applying means 17, thus preventing the carrier from dropping and adhering onto the photoconductor 3 even when the magnetic developing roller 4a becomes sparsely loaded with developer after the shutter 4b is closed.

The images thus made visible on the photoconductor 3 are sequentially transferred onto the transfer intermediate member 5 by the transfer charger 8a, the toner images of separate color components being superimposed over one another on the transfer intermediate member 5 to form one completed color toner image.

The color toner image on the transfer intermediate member 5 is then transferred by means of the transfer charger 8b to the transfer paper 15 fed from either of the paper cassettes 6a or 5b. Thereafter, the transfer paper 15 is separated from the transfer intermediate member 5 by means of the separation charger 9 and conveyed by the conveyance belt 16 to the fuser unit 10 where the color image transferred to the transfer paper 15 is permanently fixed. Since the carrier adherence to the photoconductor 3 is prevented as previously mentioned, the transfer paper 15 has no carrier stuck thereupon, so that the fuser rollers 10*a* and 10*b* of the fuser unit 10 can be protected from being damaged.

EXAMPLE 2

Figure 5:
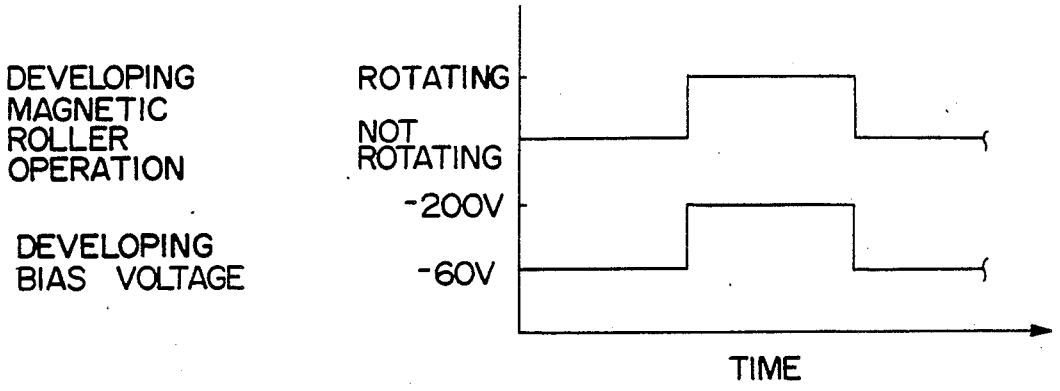
FIG. 5 is a timing chart showing the relationship between the magnetic developing roller operation and the developing bias voltage of the electrophotographic apparatus shown in FIG. 1.

In this example, as shown in FIGS. 1 and 5, the bias voltage applying means 17 is designed to apply to the developer units 4 a developing bias voltage of −200 V when the magnetic developing roller 4*a* is rotating, and −60 V when the magnetic developing roller 4*a* is not rotating. The developing bias voltage applied when the magnetic developing roller 4*a* is not rotating is thus set between 0 V and the developing bias voltage applied when the magnetic developing roller 4 is rotating, because, as described in Example 1, the relationship as shown in FIG. 4 is provided between the allowable ranges for carrier adherence and toner adherence with regard to the developing bias voltage to be applied when the magnetic developing roller 4*a* is not rotating. Accordingly, the prevention of the carrier from dropping and adhering onto the photoconductor 3 can be achieved even when the magnetic developing roller 4*a* becomes sparsely loaded with developer after the shutter 4*b* is closed. Moreover, since no carrier adheres to the transfer paper 15, the fuser rollers 10*a* and 10*b* of the fuser unit 10 are protected from being damaged.

EXAMPLE 3

Figure 6:
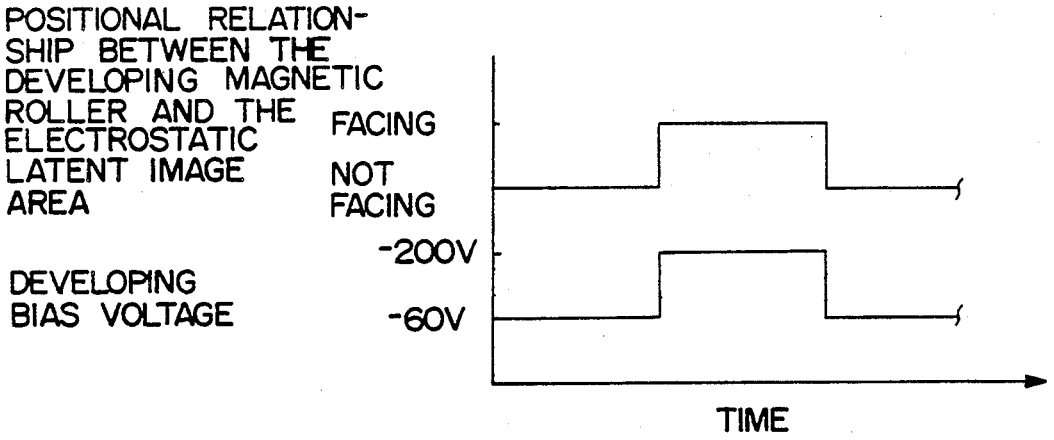
FIG. 6 is a timing chart showing the relationship between the developing bias voltage and the position between the magnetic developing roller and the electrostatic latent image area formed on the photoconductor of the electrophotographic apparatus shown in FIG. 1.

In this example, as shown in FIGS. 1 and 6, the bias voltage applying means 17 is designed to apply to the developer units 4 a developing bias voltage of −200 V when the electrostatic latent image areas are facing the magnetic developing roller 4*a*, and −60 V when the electrostatic latent images are not facing the magnetic developing roller 4*a*. The developing bias voltage applied when the electrostatic latent image areas are not facing the magnetic developing roller 4*a* is thus set between 0 V and the developing bias voltage applied when the electrostatic latent images are facing the magnetic developing roller 4*a*, because, as described in the foregoing Examples 1 and 2, the relationship as shown in FIG. 4 is provided between the allowable ranges for carrier adherence and toner adherence with regard to the developing bias voltage to be applied when the electrostatic latent image areas are not facing the magnetic developing roller 4*a*. According to the above construction, the developing bias voltage is charged from −200 V to −60 V when the electrostatic latent image areas are not facing the magnetic developing roller 4*a*, thus preventing the carrier from dropping and adhering onto the photoconductor 3 even when the magnetic developing roller 4*a* becomes sparsely loaded with developer after the shutter 4*b* is closed. Moreover, since no carrier adheres to the transfer paper 15, the fuser rollers 10*a* and 10*b* of the fuser unit 10 are protected from being damaged.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrophotographic apparatus comprising: a developer unit that has a magnetic developing roller for applying toner to electrostatic latent image areas formed on the surface of a photoconductor and that has a shutter which is closed to regulate the distribution of the toner to the photoconductor, a developing bias voltage for controlling adherence of the toner to the photoconductor being applied to said developer unit; and a bias voltage applying means for applying, when said shutter of said developer unit is closed, a developing bias voltage of a level between 0 V and the developing bias voltage applied when said shutter is opened.

2. An electrophotographic apparatus, comprising: a developer unit that has a magnetic developing roller for applying toner to electrostatic latent image areas formed on the surface of a photoconductor and that has a shutter which is closed to regulate the distribution of the toner to the photoconductor, a developing bias voltage for controlling adherence of the toner to the photoconductor being applied to said developer unit, and a bias voltage applying means for applying, when said magnetic developing roller of said developer unit is not rotating, a developing bias voltage of a level between 0 V and the developing bias voltage applied when said magnetic developing roller is rotating.

3. An electrophotographic apparatus, comprising: a developer unit that has a magnetic developing roller for applying toner to electrostatic latent image areas formed on the surface of a photoconductor and that has a shutter which is closed to regulate the distribution of the toner to the photoconductor, a developing bias voltage for controlling adherence of the toner to the photoconductor being applied to said developer unit, and a bias voltage applying means for applying, when said electrostatic latent image areas formed on the photoconductor are not facing said magnetic developing roller of said developer unit, a developing bias voltage of a level between 0 V and the developing bias voltage applied when said electrostatic latent image areas are facing said magnetic developing roller.

* * * * *